US007058160B2

(12) United States Patent
Boye

(10) Patent No.: US 7,058,160 B2
(45) Date of Patent: Jun. 6, 2006

(54) SHIELD STRUCTURE FOR X-RAY DEVICE

(75) Inventor: James R. Boye, Salt Lake City, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/933,852

(22) Filed: Sep. 3, 2004

(65) Prior Publication Data

US 2006/0050851 A1 Mar. 9, 2006

(51) Int. Cl.
*H01J 35/10* (2006.01)

(52) U.S. Cl. ..... 378/125; 378/141; 378/142

(58) Field of Classification Search ..... 378/140, 378/141, 142, 143, 144, 203, 121, 125, 138
See application file for complete search history.

(56) References Cited

U.S. PATENT DOCUMENTS 4,309,637 A * 1/1982 Fetter ..... 378/130
5,689,542 A * 11/1997 Lavering et al. ..... 378/142
6,115,454 A * 9/2000 Andrews et al. ..... 378/140
6,674,838 B1 * 1/2004 Barrett ..... 378/125

* cited by examiner

*Primary Examiner*—Courtney Thomas
(74) *Attorney, Agent, or Firm*—Workman Nydegger

(57) ABSTRACT

A shield structure is provided that is suitable for use in connection with an x-ray device that includes an anode and cathode disposed in a vacuum enclosure in a spaced apart arrangement so that a target surface of the anode is positioned to receive electrons emitted by the cathode. The shield structure is configured to be interposed between the anode and the cathode and includes an interior surface that defines an aperture through which the electrons are passed from the cathode to the target surface of the anode. Additionally, the aperture includes an inlet and an outlet sized so that the area of the inlet is relatively smaller than the area of the outlet. Finally, the shield structure is situated in the x-ray device such that the inlet of the aperture is positioned near the cathode and the outlet of the aperture is positioned near the anode target surface.

28 Claims, 3 Drawing Sheets

SHIELD STRUCTURE FOR X-RAY DEVICE

RELATED APPLICATIONS

Not applicable.

BACKGROUND OF THE INVENTION

1. Field of the Invention

The present invention relates generally to x-ray systems and devices. More particularly, embodiments of the invention concern an x-ray device shield structure that facilitates control of problems such as gas arcing and heat concentrations.

2. Related Technology

X-ray systems and devices are valuable tools that are used in a wide variety of applications, both industrial and medical. For example, such equipment is commonly used in areas such as diagnostic and therapeutic radiology; semiconductor manufacture and fabrication; and materials analysis and testing.

While used in a number of different applications, the basic operation of x-ray devices is similar. In general, x-rays, or x-ray radiation, are produced when electrons are produced and released, accelerated, and then stopped abruptly. A typical x-ray device includes an x-ray tube having a vacuum enclosure collectively defined by a cathode cylinder and an anode housing. An electron generator, such as a cathode, is disposed within the cathode cylinder and includes a filament that is connected to an electrical power source such that the supply of electrical power to the filament causes the filament to generate electrons by the process of thermionic emission. The anode is disposed in the anode housing in a spaced apart arrangement with respect to the cathode. The anode includes a target surface oriented to receive electrons emitted by the cathode. Typically, the target surface is composed of a material having a high atomic number so that a portion of the kinetic energy of the striking electron stream is converted to electromagnetic waves of very high frequency, namely, x-rays.

In operation, the electrons are rapidly accelerated from the cathode to the anode under the influence of a high potential between the cathode and the anode that is created in connection with a suitable voltage source. The accelerating electrons then strike the target surface, sometimes referred to as a "focal track," at a high velocity. The resulting x-rays emanate from the target surface, and are then collimated through a window formed in the x-ray device for penetration into an object, such as a the body of a patient. The x-rays that pass through the object can then be detected and analyzed so as to be used in any one of a number of applications, such as x-ray medical diagnostic examination or material analysis procedures.

A relatively large percentage of the electrons that strike target surface of the anode do not cause the generation of x-rays however and, instead, simply rebound from the target surface. Such electrons are sometimes referred to as "backscatter" electrons. In some x-ray tubes, some of these rebounding electrons are blocked and collected by an electron collector that is positioned between the cathode and the anode so that rebounding electrons do not re-strike the target surface of the anode. In general, the electron collector thus prevents the rebounding electrons from re-impacting the target anode and producing "off-focus" x-rays, which can negatively affect the quality of the x-ray image.

Typically, such electron collectors define an aperture through which the emitted electrons pass from the cathode to the target surface of the anode. To this end, the aperture includes or defines an inlet positioned near the cathode, as well as an outlet positioned near the target surface of the anode. In at least one implementation, the aperture is configured so that the inlet has a diameter that is relatively larger than the diameter of the outlet.

While such electron collectors have proven useful in some applications, some problems nonetheless remain. For example, the relatively close proximity between the small diameter outlet of the aperture and the target surface of the anode sometimes results in undesirable heat concentrations at the outlet. Such heat concentrations can cause, among other things, thermal stress and strain that may ultimately contribute to structural failure of the collector. More particularly, non-uniform thermal expansion of structural elements, such as is produced by high temperature differentials, induces destructive mechanical stresses and strains that can ultimately cause a mechanical failure in the part. Further, because the inlet of typical electron collectors is relatively larger than the inlet, backscattered electrons can readily rebound through the inlet and strike the cathode, thereby damaging the cathode and/or interfering with the electrons emitted from the cathode.

Yet other concerns with some typical electron collectors relate to anomalous current flows, such as arcing, within the x-ray device. More particularly, outgassing of metal and glass x-ray device components is generally employed to remove gases adsorbed to the surfaces of those components. The removal of these gases enables a relatively higher vacuum to be achieved in the evacuated enclosure of the x-ray device. In general, outgassing involves heating the x-ray device components to a high temperature for a predetermined period of time. However, typical outgassing processes do not remove all of the adsorbed gas, and some gases, whether present on or under the surfaces of such components, often remain even after outgassing has been performed. As discussed below, these remaining gases, as well as gases that may be produced during normal x-ray device operations, tend to accentuate certain shortcomings associated with typical electron collectors.

In particular, it was noted earlier herein that typical electron collectors are arranged with the large diameter portion of the aperture located near the cathode. Thus, a relatively large portion of the electron collection surface, where adsorbed gases are commonly present, is located in relatively close proximity to the cathode, where the electrical field strength is at or near a maximum. When an exposure commences, adsorbed gases tend to desorb, or ionize, as a result of the heat generated. The presence of the ionized gas in the strong electrical field near the cathode results in gas arcing and/or other anomalous current flow in the high field region. Among other things, such current effects compromise the performance and service life of the x-ray device and can damage or destroy the components of the x-ray device.

In view of the foregoing, and other, problems in the art, what is needed is a shield structure that at least partially attenuates heat concentration problems associated with some known electron collectors. In addition, the shield structure should contribute to a reduction in anomalous current flows within the x-ray device.

BRIEF SUMMARY OF AN EXEMPLARY EMBODIMENT OF THE INVENTION

In general, embodiments of the invention are concerned with a shield structure configured to contribute to the attenuation of heat concentrations and anomalous current flows in x-ray devices. More particularly, exemplary embodiments of the invention are directed to a shield structure defining an aperture and including a collection surface generally configured to be oriented toward the target surface of an x-ray device anode so as to reduce heat concentration at the inlet of the aperture, while also reducing the amount of gas arcing that occurs in the high field region of the x-ray device.

In one exemplary embodiment of the invention, a shield structure is provided that is configured to be interposed between a cathode and anode of an x-ray device. In this exemplary implementation, the shield structure is suitable for employment in a rotating anode type x-ray device. The shield structure includes an interior surface that defines an aperture through which the electrons are passed from the cathode to the target surface of the anode. The aperture includes an inlet and an outlet and, in this exemplary implementation, the inlet has a relatively smaller area than the outlet. Finally, the shield structure is configured so that when positioned between the cathode and the target surface of the anode, the inlet of the aperture is positioned proximate the cathode and the outlet of the aperture is positioned proximate the target surface of the anode.

In operation, electrons generated by the cathode pass first through the inlet of the aperture and then through the outlet of the aperture, striking the target surface of the anode. At least some of the emitted electrons rebound from the anode and strike the interior surface of the shield structure. Because the inlet of the aperture is located proximate the cathode however, fewer of the rebound electrons are able to pass through the relatively smaller inlet and strike the cathode than would otherwise be the case. Moreover, the placement of the inlet away from the target surface, and relatively closer to the cathode, results in improved heat dissipation from the target surface through the shield structure. Finally, the configuration and orientation of the shield structure means that ionized gas from the interior surface of the shield structure tends to be produced in the lower power region of the electrical field, so that gas arcing and related anomalous current flow effects are thereby reduced, or eliminated.

In this way, exemplary embodiments of the invention provide for, among other things, attenuation of heat concentrations and anomalous current flow phenomena in x-ray devices. These and other, aspects of embodiments of the present invention will become more fully apparent from the following description and appended claims.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF SELECTED EMBODIMENTS OF THE INVENTION

Reference will now be made to the drawings to describe various aspects of exemplary embodiments of the invention. It is to be understood that the drawings are diagrammatic and schematic representations of such exemplary embodiments, and are not limiting of the present invention, nor are they necessarily drawn to scale.

In general, embodiments of the invention are concerned with embodiments of a shield structure that at least partially attenuates heat concentration problems associated with some known electron collectors. In addition, exemplary implementations of the shield structure contribute to a reduction in anomalous current flows within the x-ray device.

I. Aspects of an Exemplary Operating Environment for the Shield Structure

Figure 1:
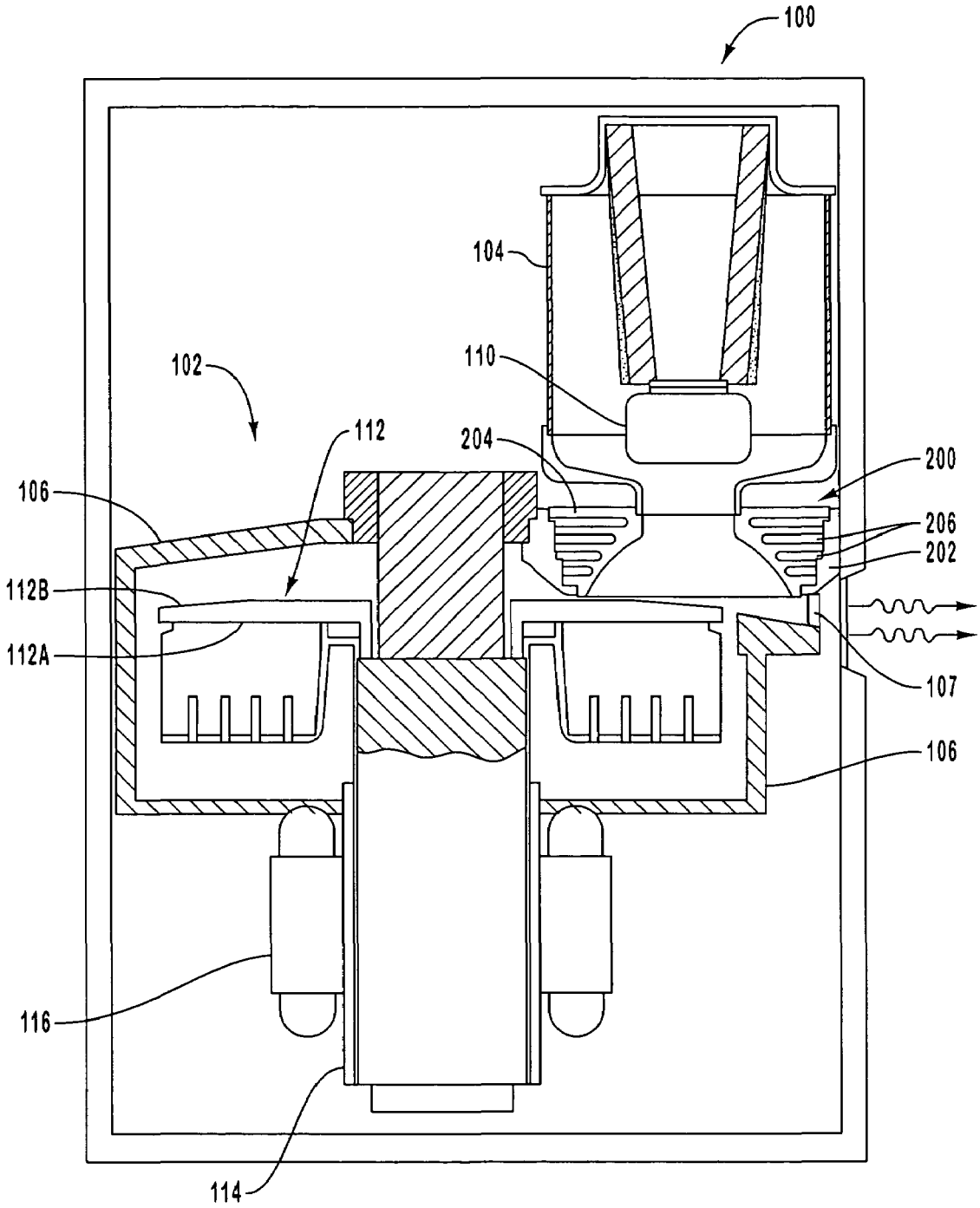
FIG. 1 is a top view illustrating various aspects of an exemplary operating environment for a shield structure.

Directing particular attention now to FIG. 1, details are provided concerning various aspects of an x-ray device, denoted generally at 100 wherein exemplary embodiments of a shield structure 200 and associated housing 202 may be employed. While exemplary embodiments of the shield structure 200 are well-suited for use in connection with rotating anode type x-ray devices, the scope of the invention is not so limited. Rather, embodiments of the shield structure 200 may be employed in any application where the functionality disclosed herein would prove useful.

The illustrated implementation of the x-ray device 100 includes a vacuum enclosure 102 cooperatively defined, at least in part, by a cathode can 104 and an anode housing 106. A window 107, substantially composed of beryllium or other suitable material, in the vacuum enclosure 102 allows generated x-rays to pass out of the x-ray device 100.

An adapter 108 having a socket 108A receives the open end of the cathode can 104 in socket 108A. The cathode can 104 is attached to the adapter 108 by any suitable process including, but not limited to, welding or brazing. In some implementations, the adapter 108 does not include sockets and the cathode can 104 is butt welded to the adapter 108.

Disposed within the cathode can 104 is a cathode 110. The cathode 110 includes a filament (not shown) configured for connection to an electrical power source (not shown) such that when power from the electrical power source is supplied to the filament, electrons are emitted from the filament by therminionic emission. The cathode 110, as well as the anode (discussed below), is also configured for connection with a high voltage source.

The x-ray device 100 further includes a rotating type anode 112 that includes a substrate 112A upon which is disposed the target surface 112B, exemplarily composed of tungsten or other suitable material(s). The anode 112 is rotatably supported by a bearing assembly 114, and a stator 116 is provided that, when energized, causes the anode 112 to rotate at high speed. In the exemplary illustrated arrangement, only the anode 112 and bearing assembly 114 are disposed in the anode housing 106, while the stator 116 is positioned outside the anode housing 106.

With continuing attention to FIG. 1, a shield structure 200 is provided that is interposed between the cathode 110 and the anode 112. In the exemplary illustrated implementation, the shield structure 200 cooperates with the cathode can 104 and the anode housing 106 to define the vacuum enclosure 102.

In general, the shield structure 200 is configured to pass electrons emitted by the cathode 110 to the target surface 112B of the anode 112. At least some implementations of the shield structure 200 define, or otherwise incorporate or include, one or more fluid passageways through which coolant is passed so as to remove heat from the shield structure 200. Exemplary implementations of the shield structure 200 additionally, or alternatively, include various structural elements, such as extended surfaces 204, configured and arranged to cooperate with other structures such as, but not limited to, the housing 202, adapter 108, anode housing 106 and/or other structures, to define one or more fluid passageways 206 through which a coolant is circulated. Examples of such structural elements and aspects, as employed in connection with a shield structure, are disclosed and claimed in U.S. Pat. No. 6,400,799, entitled *X-RAY TUBE COOLING SYSTEM*, and issued to Andrews on Jun. 4, 2002, and incorporated herein in its entirety by this reference.

II. Aspects of an Exemplary Implementation of a Shield Structure

Figure 2:
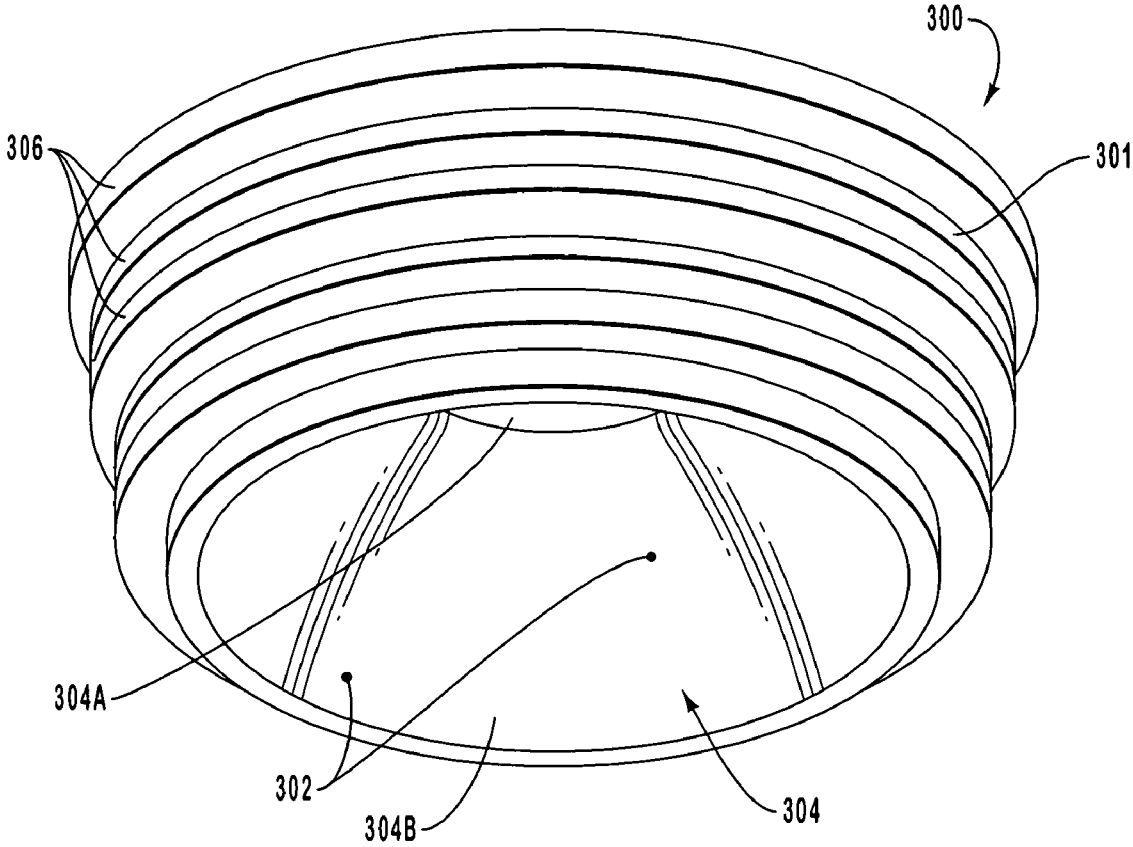
FIG. 2 is a perspective view of an exemplary implementation of a shield structure.
Figure 3:
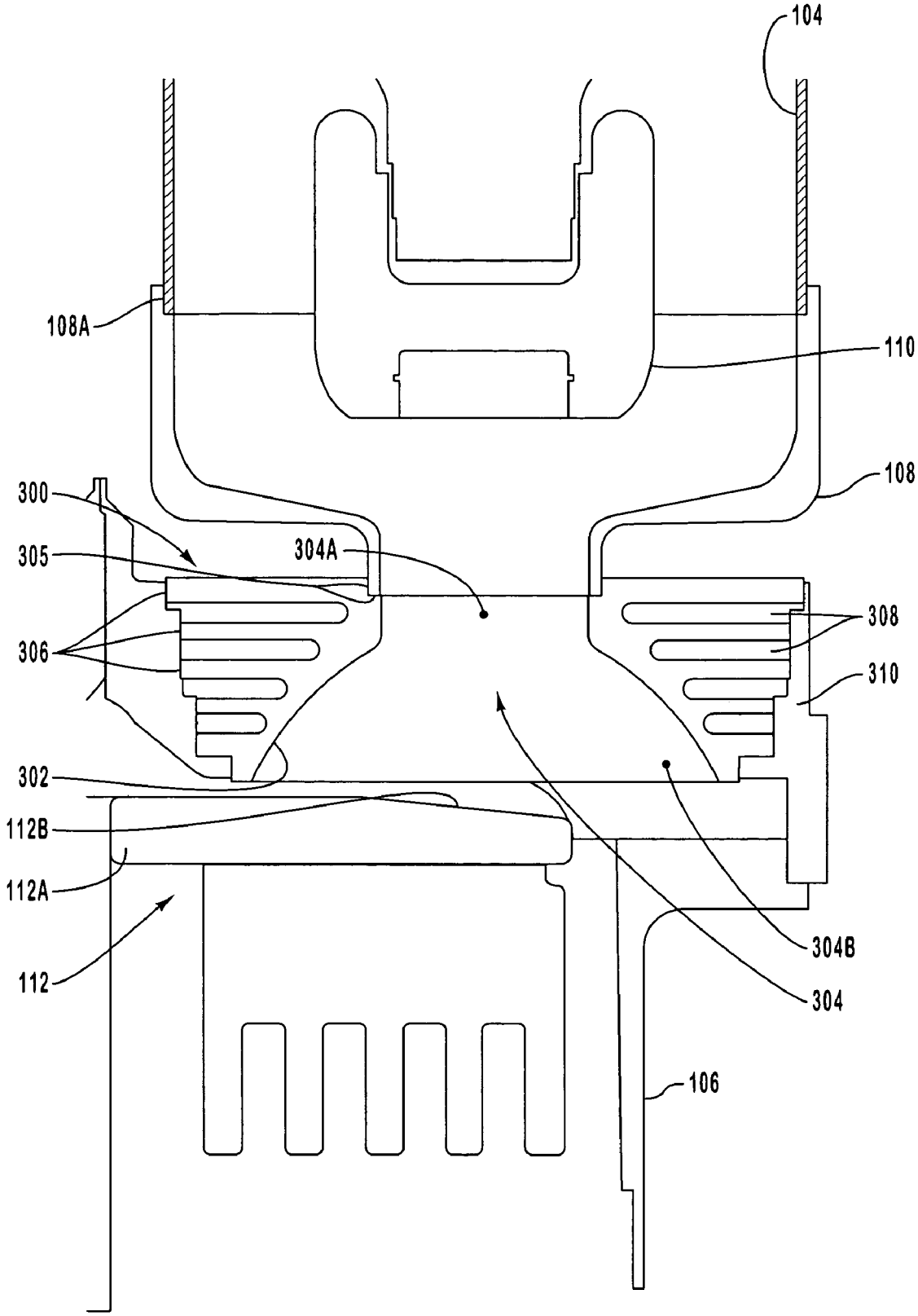
FIG. 3 is a detail section view illustrating aspects of an exemplary implementation of a shield structure as such aspects relate to an x-ray device.

Directing attention now to FIGS. 2 and 3, and with continuing attention to FIG. 1, further details are provided concerning an exemplary implementation of a shield structure, denoted generally at 300. Exemplary embodiments of the shield structure 300 (see FIGS. 2 and 3) are substantially composed of copper or a copper alloy. Any other suitable material(s) may likewise be employed however. Moreover, the shield structure 300 is, in some exemplary implementations, integral with the cathode can 104, adapter 108 or the anode housing 106. Accordingly, the scope of the invention should not be construed to be limited to any particular implementation of the shield structure 300.

As best illustrated in FIGS. 2 and 3, the shield structure 300 includes a body 301 having an interior surface 302 that defines an aperture 304 that allows the electron stream to pass from the cathode 110 to the target surface 112B of the anode 112 (see FIG. 1). The aperture 304 includes an inlet 304A and an outlet 304B. In this exemplary implementation, the aperture 304, inlet 304A and outlet 304B are all substantially circular in shape and, further, the inlet 304A and outlet 304B are substantially coaxial with each other. However, the scope of the invention is not so limited. For example, in some implementations, one or more of the aperture 304, inlet 304A and outlet 304B have a non-circular geometry, such as an oval shape. Moreover, the inlet 304A and outlet 304B need not be coaxial with each other.

In the illustrated implementation, the aperture 304 defined by the interior surface 302 includes a substantially tubular section configured and arranged to be attached to the adapter 108. This implementation is exemplary only and should not be construed to limit the scope of the invention in any way. For example, some implementations of the shield structure 300 do not include such a tubular section.

With continuing reference now to FIGS. 2 and 3 in particular, the inlet 304A has an area that is less than the area of the outlet 304B. In the exemplary implementation of the shield structure 300 where the inlet 304A and outlet 304B are substantially circular in shape, this means that the diameter of the inlet 304A is relatively smaller than the diameter of the outlet 304B. Additionally, the interior surface 302 is generally concave in form. In one exemplary implementation, best illustrated in the cross-section view of FIG. 3, the interior surface 302 curves between the inlet 304A and the outlet 304B. In other exemplary implementations however, the interior surface 302 is implemented in another type of concave form. In particular, the interior surface 302 is also implemented in a substantially frusto-conical cross-sectional shape such that the interior surface 302 describes a substantially straight line between the inlet 304A and the outlet 304B.

In either case however, the interior surface 302 of the shield structure is configured so as to be oriented toward the target surface 112B of the anode 112 and away from the cathode 110, as indicated in FIGS. 1 and 3, when the shield structure 300 is positioned between the cathode 110 and the anode 112. Consequently, the inlet 304A is located proximate the cathode 110, while the outlet 304B is located proximate the anode 112, as indicated in FIGS. 1 and 3. As discussed in further detail elsewhere herein, such arrangements have various useful implications.

As best illustrated in FIG. 3, the shield structure 300 also defines a socket 305 located near the inlet 304A. The socket 305 is generally configured and arranged to amate with a portion of the adapter 108, as shown.

Additionally, at least some implementations of the shield structure include one or more extended surfaces 306 that are substantially annular. In the illustrated embodiment, each of the extended surfaces 306 defines a substantially rectangular cross-section, but the scope of the invention is not so limited. Rather, aspects such as, but not limited to, the size, shape, spacing, arrangement and orientation of the extended surface(s) 306 may be varied as necessary to suit the requirements of a particular application.

As the Figures indicate, the extended surfaces 306 cooperate with each other to at least partially define one or more fluid passageways 308. In some implementations, a housing 310 (see FIGS. 2 and 3) is also provided within which the shield structure 300 is received. In at least some of such implementations, the fluid passageways 308 are cooperatively defined by the extended surfaces 306 of the shield structure 300 and the housing 310. In any case, the fluid passageways 308 are configured and arranged to allow a flow of coolant, generated and provided by a suitable cooling system (not shown) to be directed into contact with portions of the shield structure 300 so as to effect convective and conductive cooling of the shield structure 300. To this end, exemplary implementations of the shield structure further define, or otherwise include, at least one coolant inlet port and at least one coolant outlet port, both of which are in fluid communication with the fluid passageway(s) 308.

With more particular attention now to the housing 310, some exemplary embodiments of the shield structure 300 are configured so that the shield structure 300 is integral with the housing 310 which, in turn, is configured to be attached to one, or both, of the cathode can 104 and the anode housing 106, such as by welding or brazing. In yet other implementations however, the shield structure 300 and housing 310 are discrete structures. The housing 310, similar to the shield structure 300 is exemplarily composed of copper or a copper alloy, but other suitable materials may be employed as well in the construction of the housing 310.

As noted earlier, some implementations of the housing 310 cooperate with the shield structure 300 to define one or more fluid passageways that facilitate cooling of the shield structure. In order to further facilitate such cooling, some exemplary implementations of the housing 310 additionally include a plurality of extended surfaces (not shown) on the exterior portion of the housing 310 so that in implementations where the x-ray device 100 is immersed in a coolant reservoir (see FIG. 1), the extended surfaces of the housing 310 contact the coolant and transfer heat from the shield structure 300 to the coolant in the coolant reservoir.

In yet other implementations, the housing 310 is constructed so that the shield structure 300 is only partially received in the housing 310. In some of these implementations, the portion of the shield structure 300 that remains outside the housing 310 includes a plurality of extended surfaces configured and arranged for substantial contact with coolant contained in a coolant reservoir.

III. Operational Aspects of an Exemplary Implementation of a Shield Structure

With continuing reference to FIGS. 1 through 3, details are provided concerning various operational aspects of an exemplary implementation of a shield structure as employed in an x-ray device operating environment.

In operation, power is applied to the cathode 110, and a high potential established between the cathode 110 and the anode 112. The power applied to the cathode 110 causes the thermionic emission of electrons from the cathode filament and the high voltage causes the electrons to accelerate rapidly toward the target surface 112B of the anode 112. As the electrons strike the target surface 112B, x-rays are produced that pass through the window 107.

At least some of the x-rays that strike the target surface 112B rebound from the target surface 112B toward the cathode 110 and/or other structures and elements of the x-ray device 100. As noted earlier, such rebound electrons still possess significant kinetic energy that is transformed to heat when the rebound electrons strikes a portion of the x-ray device 100. However, because the inlet 304A of the shield structure 300 is relatively small, as compared with the outlet 304B, many of the rebound electrons harmlessly strike the interior surface 302 instead of the cathode 110. Thus, the configuration and positioning of the shield structure 300 reduces the number of rebound or backscatter electrons that are able to strike sensitive elements of the x-ray device 100, such as the cathode 110, thereby reducing the heat load on the cathode 110 and, accordingly, the likelihood that the cathode 110 will be damaged as a result of excessive heat.

Additionally, the positioning of the interior surface 302 of the shield structure 300 toward the anode 112 and away from the cathode 110 attenuates heat concentrations that occur at the inlet of some typical shield structures. More particularly, the rebound electrons tend to strike the interior surface 302 at various locations, so that the heat load produced by the impacts of such rebound electrons is distributed relatively evenly over the interior surface 302.

In contrast, typical shield structures are disposed in the opposite orientation with respect to the cathode 110 and the anode 112 so that, in such arrangements, a large portion of the rebound electrons strike the structure immediately adjacent to the relatively small aperture outlet, thereby concentrating the heat load near this aperture outlet. As noted elsewhere herein, this problem is aggravated by the fact that the small size of the aperture outlet permits only a relatively limited number of rebound electrons to pass through the aperture.

A related aspect of the configuration and arrangement of the shield structure 300 indicated in FIGS. 1 and 3 is that because the inlet 304A is located relatively further from the target surface 112B of the anode 112, as compared with the configuration and arrangement of typical shield structures, the heat load imposed on the inlet 304A by x-ray generation at the target surface 112B is reduced. Among other things, the distribution and/or reduction of heat loads that is effectuated by embodiments of the shield structure 300 contributes to a relative reduction in destructive thermal stresses and strain, and attendant effects, in the x-ray device 100 and associated structures.

Yet other aspects of the configuration and arrangement of the shield structure 300 concern anomalous current effects, such as arcing, that sometimes occur in x-ray devices. It was noted earlier herein that outgassing of adsorbed gases often occurs in x-ray devices and, further, that such outgassing often contributes to gas arcing when ionized gas is present in the high strength area of the electrical field between the cathode and the anode. More particularly, outgassing commonly occurs during exposure operations performed by the x-ray device. Between exposures, the gas collects on x-ray component surfaces, such as the interior surface of the shield structure. When an exposure is initiated, the gas is ionized and, as a result of the arrangement of typical shield structures, the ionized gas tends to be concentrated in the high strength area of the electrical field, namely, near the cathode. The presence of the ionized gas, in combination with the strong electrical field causes arcing and/or other undesirable anomalous current effects.

However, embodiments of the shield structure 300 are configured and arranged so that a significant portion of the interior surface 302, where gas is likely to be present, is relatively closer to the anode 112 than to the cathode 110. In connection with the foregoing, it was noted earlier that the strength of the electrical field generally diminishes as the distance from the anode 112 increases. Among other things then, implementations of the shield structure 300 contrast with typical shield structures in that the configuration and arrangement of exemplary embodiments of the shield structure 300 are such that the concentration of ionized gas generated as a result of offgassing tends to be relatively higher in the low strength area of the electrical field. Consequently, implementations of the shield structure 300 contribute to a relative reduction in gas arcing in the x-ray device 100.

Embodiments of the shield structure 300 to contribute to improvements in the performance of the x-ray device 100 in other ways as well. In particular, during the operation of the x-ray device 100, circulation of coolant through the fluid passageways defined in connection with exemplary embodiments of the shield structure 300 removes heat from the x-ray device 100, thereby reducing the likelihood of thermally induced damage to the x-ray device 100 and its components. The presence of extended surfaces or similar structures in some embodiments of the shield structure 300 further enhances and contributes to such heat removal.

The described embodiments are to be considered in all respects only as exemplary and not restrictive. The scope of the invention is, therefore, indicated by the appended claims rather than by the foregoing description. All changes which come within the meaning and range of equivalency of the claims are to be embraced within their scope.

The invention claimed is:

1. An x-ray device, comprising:

an vacuum enclosure including a cathode housing portion and an anode housing portion;

an anode substantially disposed in the anode housing portion and a cathode substantially disposed in the cathode housing portion such that the anode and the cathode are positioned in a spaced apart arrangement so that a target surface of the anode is positioned to receive electrons emitted by the cathode;

a shield structure interposed between the anode and the cathode, the shield structure including an interior surface that defines an aperture through which the electrons are passed from the cathode to the target surface of the anode, the aperture having an inlet and an outlet, an area of the inlet being relatively smaller than an area of the outlet, and the shield structure being situated such that the inlet of the aperture is positioned proximate the cathode and the outlet of the aperture is positioned proximate the target surface of the anode; and an adapter having a first end and a second end, wherein a region of the inlet includes a mating surface configured to mate with the first end of an adapter, and the second end is configured for attachment with an open end of the cathode housing.

2. The x-ray device as recited in claim 1, wherein at least one of the following is substantially circular: the aperture; the inlet; and, the outlet.

3. The x-ray device as recited in claim 1, wherein the interior surface is substantially concave.

4. The x-ray device as recited in claim 1, wherein the shield structure substantially comprises one of: copper; and, copper alloy.

5. The x-ray device as recited in claim 1, wherein a diameter of the inlet of the aperture is relatively smaller than a diameter of the outlet of the aperture.

6. The x-ray device as recited in claim 1, wherein the inlet and the outlet of the aperture are substantially coaxial with respect to each other.

7. The x-ray device as recited in claim 1, wherein the interior surface of the shield structure is oriented so as to face toward the anode.

8. The x-ray device as recited in claim 1, wherein the shield structure at least partially defines a fluid passageway.

9. The x-ray device as recited in claim 1, wherein the cathode is substantially coaxial with at least the inlet of the aperture.

10. The x-ray device as recited in claim 1, wherein the anode comprises a rotating anode.

11. The x-ray device as recited in claim 1, wherein the surface is formed as a socket for connection to the first end of the adapter.

12. The x-ray device as recited in claim 1, further comprising:

a coolant reservoir wherein at least a portion of the vacuum enclosure is disposed; and an external cooling system in fluid communication with the coolant reservoir.

13. The x-ray device as recited in claim 1, further comprising a housing wherein at least a portion of the shield structure is received.

14. An x-ray device, comprising:

an vacuum enclosure, at least a portion of which includes a shield housing portion;

a rotating anode and a cathode substantially disposed in the vacuum enclosure in a spaced apart arrangement so that a target surface of the rotating anode is positioned to receive electrons emitted by the cathode;

a shield structure comprising a body and interposed between the anode and the cathode, the shield structure including a substantially concave interior surface that at least partially defines an aperture through which the electrons are passed from the cathode to the target surface of the anode, the aperture having an inlet and an outlet, and the shield structure being situated such that the substantially concave interior surface is oriented towards the target surface of the anode; and at least one extended surface attached to the body, wherein at least one extended surface interfaces with the shield housing so as to define a fluid passageway.

15. The x-ray device as recited in claim 14, wherein a diameter of the inlet is relatively smaller than a diameter of the outlet.

16. The x-ray device as recited in claim 14, wherein the aperture, the inlet, and the outlet are substantially circular.

17. The x-ray device as recited in claim 14, wherein the body substantially comprises one of: copper; and, copper alloy.

18. The x-ray device as recited in claim 14, wherein the anode comprises a rotating anode.

19. The x-ray device as recited in claim 14, further comprising an adapter to which the cathode and the body are at least indirectly attached.

20. The x-ray device as recited in claim 14, further comprising a plurality of substantially annular extended surfaces attached to the body.

21. A shield structure suitable for use in connection with an x-ray device having an evacuated enclosure within which are disposed a cathode and anode, the cathode and anode being arranged so that a target surface of the anode is positioned to receive electrons emitted by the cathode, the shield structure being configured to be interposed between the cathode and the target surface of the anode, and the shield structure comprising:

a body having an interior surface that defines an aperture through which the electrons are passed from the cathode to the target surface of the anode, the aperture having an inlet and an outlet, an area of the inlet being relatively smaller than an area of the outlet and, when the shield structure is positioned between the cathode and the target surface of the anode, the inlet of the aperture is positioned proximate the cathode and the outlet of the aperture is positioned proximate the target surface of the anode; and a plurality of extended surfaces attached to the body, wherein at least one of the extended surfaces interface with an interior surface of the evacuated enclosure so as to define a substantially enclosed fluid passageway.

22. The shield structure as recited in claim 21, wherein at least one of the following is substantially circular: the aperture; the inlet; and, the outlet.

23. The shield structure as recited in claim 21, wherein the interior surface is substantially concave.

24. The shield structure as recited in claim 21, wherein the shield structure substantially comprises one of: copper; and, copper alloy.

25. The shield structure as recited in claim 21, wherein the inlet and the outlet of the aperture are substantially coaxial with respect to each other.

26. The shield structure as recited in claim 21, wherein at least one extended surface is substantially annular with respect to the body.

27. The shield structure as recited in claim 21, wherein the inlet and the outlet of the aperture are substantially coaxial with respect to each other.

28. The shield structure as recited in claim 21, wherein the a mating surface is defined in the region of the inlet, the mating surface configured for attaching the body to the evacuated enclosure.

* * * * *